US008794271B2

(12) United States Patent
Zhang et al.

(10) Patent No.: US 8,794,271 B2
(45) Date of Patent: Aug. 5, 2014

(54) ELECTRONIC DOBBY-AND-JACQUARD-LOOM WEAVING MACHINE AND WEAVING METHOD

(71) Applicants: Zhejiang Sanzhi Textiles Co., Ltd., Huzhou (CN); Changshu Textile Machinery Works Co., Ltd., Changshu (CN); Suzhou Huayi Machine Co., Ltd., Wujiang (CN)

(72) Inventors: Shengcheng Zhang, Huzhou (CN); Chenhui Qian, Changshu (CN); Xiaodong Li, Wujiang (CN); Dexun Ye, Huzhou (CN); Yunfei Yao, Huzhou (CN); Jun Zhang, Changshu (CN); Yaojun Han, Huzhou (CN); Xiaofang Chen, Huzhou (CN); Shuifa Ding, Huzhou (CN); Xiaohong Peng, Changshu (CN); Jianhua Chen, Wujiang (CN)

(73) Assignees: Zhejiang Sanzhi Textiles Co., Ltd., Huzhou, Zhejiang Province (CN); Changshu Textile Machinery Works Co., Ltd., Changshu, Jiangsu Province (CN); Suzhou Huayi Machine Co., Ltd., Wujiang, Jiangsu Province (CN)

( * ) Notice: Subject to any disclaimer, the term of this patent is extended or adjusted under 35 U.S.C. 154(b) by 0 days.

(21) Appl. No.: 13/716,536

(22) Filed: Dec. 17, 2012

(65) Prior Publication Data

US 2013/0269822 A1 Oct. 17, 2013

(30) Foreign Application Priority Data

| | | |
|---|---|---|
| Dec. 20, 2011 | (CN) | 2011 1 0428463 |
| Apr. 16, 2012 | (CN) | 2012 2 0161451 U |
| May 31, 2012 | (CN) | 2012 2 0258592 U |

(51) Int. Cl.

| | |
|---|---|
| ***D03C 13/00*** | (2006.01) |
| ***D03C 1/16*** | (2006.01) |
| ***D03C 3/20*** | (2006.01) |
| *D03C 19/00* | (2006.01) |
| *D03C 1/00* | (2006.01) |
| *D03C 3/00* | (2006.01) |

(52) U.S. Cl.

CPC .. *D03C 1/16* (2013.01); *D03C 3/20* (2013.01); *D03C 1/00* (2013.01); *D03C 3/00* (2013.01)

USPC ..... 139/55.1; 139/11; 139/59; 139/66 R; 139/82; 139/91

(58) Field of Classification Search

CPC .. D03C 19/00; D03C 1/14; D03C 2700/0177; D03C 3/20; D03C 3/205; D03C 3/24; D03C 3/26; D03C 1/00; D03C 2700/0133; D03C 13/00; D03C 5/00; D03C 3/00; D03C 1/16; D03C 1/144; D03C 9/00; D03C 2700/0127; D03C 13/025; D03C 1/10; D03C 1/146; D03C 2700/01; D03C 17/00; D03C 1/12; D03C 2700/14; D03C 7/00; D02H 9/00; G06T 11/001; D03D 51/46; D03D 47/262; D03D 51/02; D03D 2700/26

USPC ..... 139/55.1, 59, 66 R, 68, 71, 1 R, 1 E, 317, 139/328, 331, 327

See application file for complete search history.

(56) References Cited

U.S. PATENT DOCUMENTS

| | | | | |
|---|---|---|---|---|
| 3,381,719 | A * | 5/1968 | Favre | 139/68 |
| 3,833,027 | A * | 9/1974 | Pavlica | 139/71 |

(Continued)

*Primary Examiner* — Bobby Muromoto, Jr.

(74) *Attorney, Agent, or Firm* — Jacobson Holman PLLC; Jiwen Chen

(57) ABSTRACT

The present invention discloses an electronic-dobby-and-jacquard-loom weaving machine and a weaving method. The machine comprises a weaving body, a first warp beam, a second warp beam, a jacquard loom, a dobby loom, a harness frame, a plurality of first harness wires, a plurality of second harness wires, a plurality of harness cords, a plurality of return springs and at least one weft accumulator, wherein the weaving body and the jacquard loom are connected with a synchronous transmission mechanism between them; the synchronous transmission mechanism comprises a weaving spindle, a main motor encoder, a jacquard loom transmission shaft, a jacquard loom encoder, a gear box and a servo control system. The present invention improves the clarity of the fell (shed), widens the fell, keeps the fell clear stably, and realizes high-density jacquard weaving.

10 Claims, 4 Drawing Sheets

(56) References Cited

U.S. PATENT DOCUMENTS

| | | | | |
|---|---|---|---|---|
| 4,172,475 | A * | 10/1979 | Schwarz et al. | 139/66 R |
| 5,429,686 | A * | 7/1995 | Chiu et al. | 139/383 A |
| 6,185,475 | B1 * | 2/2001 | Chung | 700/131 |
| 7,571,746 | B2 * | 8/2009 | Hay et al. | 139/383 A |
| 2003/0170419 | A1 * | 9/2003 | Emery et al. | 428/91 |
| 2006/0162801 | A1 * | 7/2006 | Debaes | 139/55.1 |
| 2006/0214484 | A1 * | 9/2006 | Zaharakos | 297/218.1 |
| 2008/0035231 | A1 * | 2/2008 | Hay et al. | 139/420 B |
| 2011/0223398 | A1 * | 9/2011 | Dobin | 428/196 |

* cited by examiner

ELECTRONIC DOBBY-AND-JACQUARD-LOOM WEAVING MACHINE AND WEAVING METHOD

BACKGROUND OF THE INVENTION

1. Technical Field

The present invention relates to the technical field of textile technology, in particular to an electronic dobby-and-jacquard-loom weaving device and a weaving method.

2. Description of the Related Art

At present, shade curtains and jacquard curtains hold a large share on the market. However, the existing shade curtains are primarily produced by simple weaving, and then drying and patterning, which fails to meet the aesthetic tastes of modem people and greatly pollutes environment; jacquard curtains have made a breakthrough in the prior art and are very beautiful, but they provide no advantage in their shading effect. This is because the existing jacquard device can only weave a single-layer texture, and the warp density is relatively low, generally below 140 threads/cm. If this kind of device is used for weaving high warp-density texture, the shed will be not clear because the number of drawn warps is not consistent and therefore influences normal weft insertion.

Limited by the weaving device, it is difficult to achieve beautifying and shading effects with these curtains. Meanwhile, along with people's aesthetic enhancements on environmental ornaments and rooms, the original plain-color shade curtains and jacquard curtains cannot meet people's requirements for better living. Therefore, technical modification of the structure of the machine and a corresponding method for weaving wide, high-density shade jacquard fabrics has become a research hotspot.

BRIEF SUMMARY OF THE INVENTION

The objective of the present invention is to solve the problems in the prior art, provide an electronic dobby-and-jacquard-loom weaving machine, and a weaving method. The present invention effectively combines the electronic-dobby device and the jacquard device, uses a servo jacquard device to reduce the loads on the main motor of the weaving machine, and synchronize the jacquard loom and the dobby loom, thus improving the process and method, enhancing the clarity of the fell, and realizing high-density jacquard weaving.

The fulfill the above objective, the present invention provides an electronic-dobby-and-jacquard-loom weaving machine, comprising a weaving body, a first warp beam, a second warp beam, a jacquard loom, a dobby loom, a heald frame, a plurality of first harness wires, a plurality of second harness wires, a plurality of harness cords, a plurality of return springs, and at least one weft accumulator, wherein the weaving body is provided with a dobby loom, while the jacquard loom is arranged above the weaving body; the jacquard loom is provided with a plurality of harness cords of which the lower ends are connected with the first hardness wires; the lower ends of the first harness wires are connected with return springs; the lower ends of the return springs are fixed on the weaving body; the first harness wires are provided with first heald eyes; the lower part of the dobby loom is connected with the heald frame; the heald frame is provided with a plurality of second harness wires inside; the second harness wires are provided with second heald eyes; the first warp beam and the second warp beam are respectively coiled with a first warp and a second warp; either the first warp or the second warp passes through the first heald eyes, while the other passes through the second heald eyes; the first warp and the second warp form a shed along with the motion of the first and second harness wires; wefts on the weft accumulator passes through the shed.

Preferably, the weaving body and the jacquard loom are connected with a synchronous transmission mechanism between them; the synchronous transmission mechanism comprises a main shaft, a main motor encoder, a jacquard loom transmission shaft, a jacquard loom encoder, a gear box, and a servo control system; the main motor encoder is connected to the main shaft of the weaving body; the jacquard loom encoder is connected to the jacquard loom transmission shaft; the servo control system is integrated with the gear box and connected to the jacquard loom via the jacquard loom transmission shaft, and both the main motor encoder and the jacquard loom encoder are connected to the servo control system.

Preferably, the jacquard loom encoder and the main motor encoder both are differential encoders; and the weaving body is a water-spraying dobby weaver.

Preferably, the first warp shaft and the second warp shaft are distributed vertically; the first warp beam is the upper warp beam, while the second warp beam is the lower warp beam; the first warp on the first warp beam passes through the first heald eyes, the second warp on the second warp beam passes thought the second heald eyes; or the first warp on the first warp beam passes through the second heald eyes, the second warp on the second warp beam passes through the first heald eyes. Such structure is simple and convenient to operate and can achieve a good effect. The first warp beam and the second warp beam both are located on the rear of the weaving body, so the installation is convenient and the worker feels convenient during weaving.

Preferably, the weaving body is also provided with a harness board with a plurality of holes; each harness cord passes through a hole on the harness board and then is connected to the corresponding first harness wire such that the harness cord runs more stably; and the holes on the harness board are inclined holes, which is good for high-speed weaving.

Preferably, the jacquard loom is located above the dobby loom, and the opening is clearer by adjusting the opening height, which also widens the fell and good for multiple-weft weaving.

Preferably, the weaving body is also provided with a high-pressure water pump of which the nozzle directly aims at the return spring, so the slurry dropping during weaving can be quickly weaved, the service life of the return spring is improved, and the regular weaving is ensured.

Preferably, the weaving body and the jacquard loop are connected with a servo jacquard device between them; the servo jacquard device comprises a servo control system and a gear box; the servo control system is connected to the gear box; and the output end of the gear box is connected to the jacquard loom.

Preferably, the servo control system comprises a servo controller, a servo motor, a brake resistor and a signal controller; the servo controller is connected to the servo motor; the output end of the servo motor is connected to the gear box; the braking resistor and the signal controller are connected with the servo controller; the servo control system also comprises a differential encoder; and the differential encoder is connected to the servo controller.

To fulfill the above aim, the invention also provides a double-loom weaving method. The weaving body is provided with a jacquard loom and dobby loom at the same time; the jacquard loom is connected with the first harness wires via the harness cords; the lower ends of the first harness wires are connected to the return springs; the dobby loom is connected to the second harness wires; the first warp on the first warp beam passes through the first heald eyes on the first harness wires; the second warp on the second warp beam passes through the second heald eyes on the second harness wires; then the jacquard loom and the dobby loom respectively drive the first harness wire and the second harness wire to move vertically; the first warp and the second warp respectively follow the first harness wires and the second harness wires to move vertically to form two layers and form a shed such that the weft on the welt accumulator passes through the shed to move.

The present invention has the following advantages: The jacquard device is installed on the original water-spraying dobby weaver, which effectively reduces the number of needles of the jacquard loom, the density of components and the friction between the harness cords and the harness wires, is favorable for normal return of the return springs and avoids the felting and coiling phenomenon caused by friction between the warps; by the means of combining the jacquard loom and the dobby loom, the clarity of the fell (shed) is improved and stabilized, the fell is widened, and the weaving of the high-density jacquard fabrics is realized.

The servo device is introduced to separate the operation of forming the shed from the power system of the weaving machine, which reduces the loads on the main motor and the power of the spindle motor of the weaving machine and meets the power requirement for super-startup of water-spraying weaving. In comparison with the vertical shaft transmission, the serve drive not only effectively reduces noises and mechanical abrasion and saves space, but also optionally sets or changes the leveling position of the harness wires of the weaving machine by the control system during weaving and improves the weaving speed.

Two encoders are introduced; the jacquard loom runs under the control of the servo control system; when the weaving machine works, the main motor encoder transmits the signal to the servo control system; the servo control system enables the servo motor to rotate and then drives the jacquard loom to rotate by the servo motor; the jacquard loom feeds back the signal to the serve control system by the jacquard loom encoder; the servo control system determines if the rotations of the jacquard loom and the weaving machine are consistent according to the signal fed back by the jacquard loom encoder; if so, the jacquard loom and the weaving machine will continue to rotate synchronously; and if not, the two shall be adjusted to rotate synchronously by the gear box of the servo motor, thus meeting the requirements for high-density weaving.

The features and advantages of the present invention will be described in detail with reference to the embodiments and attached drawings.

DETAILED DESCRIPTION OF THE INVENTION

Figure 1:
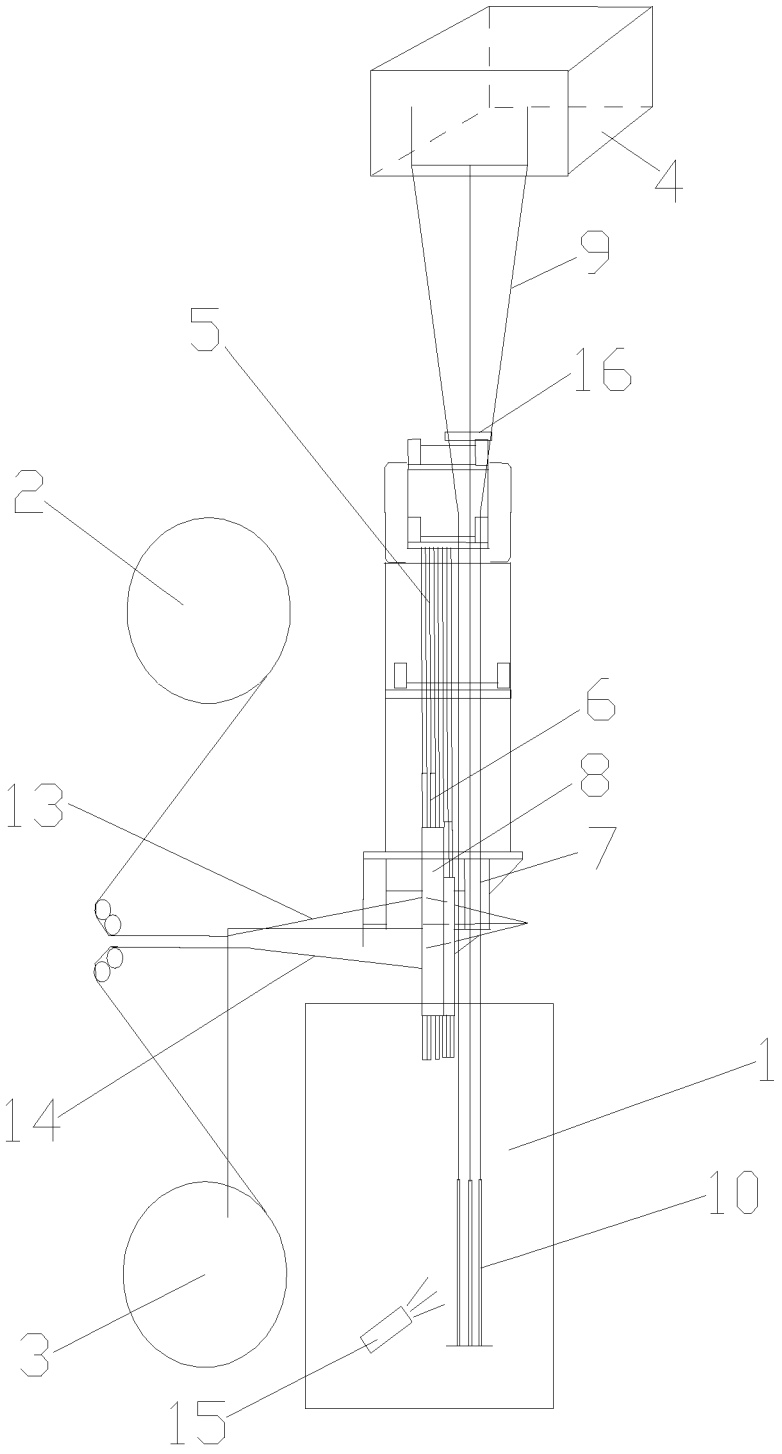
FIG. 1 illustrates a structural view of an electronic-dobby-and-jacquard-loom weaving machine of the present invention.
Figure 2:
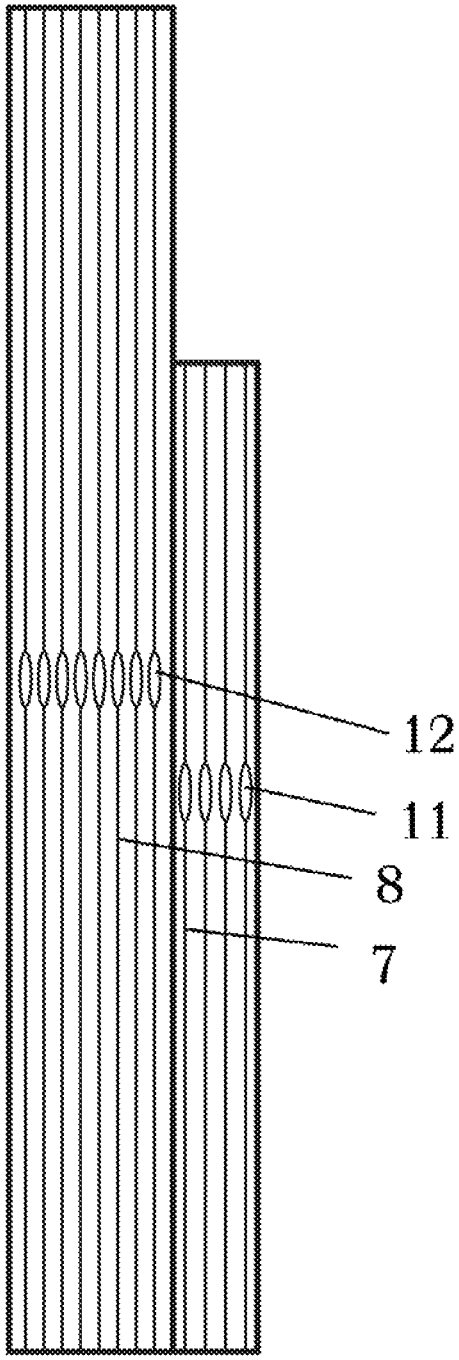
FIG. 2 illustrates a structural view of the vertical motion of first harnesses and second harnesses in an electronic-dobby-and-jacquard-loom weaving machine of the present invention.

As shown in FIGS. 1 and 2, an electronic-dobby-and-jacquard-loom weaving machine comprises a weaving body 1, a first warp beam 2, a second warp beam 3, a jacquard loom 4, a dobby loom 5, a heald frame 6, a plurality of first harness wires 7, a plurality of second harness wires 8, a plurality of harness cords 9, a plurality of return springs 10 and at least one weft accumulator (the weft accumulator is partly similar to the regular weft accumulator and therefore is not shown in the figure. Refer to the structure and position of the common weft accumulator during implementation), wherein the weaving body 1 is provided with the dobby loom 5, while the jacquard loom 4 is arranged above the weaving body 1; the jacquard loom 4 is provided with a plurality of harness cords 9 of which the lower ends are connected with the first hardness wires 7; the lower ends of the first harness wires 7 are connected with return springs 10; the lower ends of the return springs 10 are fixed on the weaving body 1; the first harness wires 7 are provided with first heald eyes 11; the lower part of the dobby loom 5 is connected with the heald frame 6; the heald frame 6 is provided with a plurality of second harness wires 8 inside; the second harness wires 8 are provided with second heald eyes 12; the first warp beam 2 and the second warp beam 3 are respectively coiled with a first warp 13 and a second warp 14; either the first warp 13 or the second warp 14 passes through the first heald eyes 11, while the other passes through the second heald eyes 12; the first warp 13 and the second warp 14 form a shed along with the motion of the first and second harness wires 7 and 8; wefts on the weft accumulator passes through the shed. The first warp beam 2 and the second warp beam 3 are vertically located; the former is the upper warp beam; and the latter is the lower warp beam. In terms of connection, the first warp 13 on the first warp beam 2 may pass through the first heald eyes 11, then the second warp 14 on the second warp beam 3 pass through the second heald eyes 12; or the first warp 13 on the first warp beam 2 may pass through the second heald eyes 12, and then the second warp 14 on the second warp beam 3 pass through the first heald eyes 11. The first heald eyes 11 and the second heald eyes 12 are on the same horizontal plane during installation, and alternatively move up and down during weaving to drive the first warp 13 and the second warp 14 to alternatively move up and down. FIG. 2 illustrates the process that the second heald eyes 12 move upward, while the first heald eyes 11 move downward. The first warp beam 2 and the second warp beam 3 both are located on the rear of the weaving body 1, so installation is more convenient and workers work more conveniently during weaving. The above structure is realized by installing the jacquard loom on the original 16-bar dobby water-spraying waver, which means that the former eight bars, blade, and harness frame 6 of the original weaver are removed, and the rear eight bars are fixed on a welded steel plate after the over beam and cutter are fixed. The jacquard loom 4 is installed on the front part. This can effectively reduce the number of needles of the jacquard loom 4, the density of components, and the friction between the harness cords 9 and the harness wires to avoid the warp from being felted and coiled due to friction, and is favorable for the return of the return springs 10 and high-density weaving. Meanwhile, the high-pressure water pump (the outlet of the high-pressure pump is the nozzle 15) is installed to wash the harness wires and the return springs 10, which can quickly wash the slurry dropped during weaving, prolong the life time of the return springs 10 and guarantee regular weaving. The motion of the warps and the filling sequence of the wefts are controlled by the jacquard loom 4, and the heald raising completed by the dobby loom is under the control of auxiliary needles. In terms of texture design, the warp ratio of the exterior to the interior is 1:1. Half of the warps (the second warp 8) are controlled by the heald frame 6, the opening is stable and clear; while the other half of the warps (the first warp 7) are controlled by the jacquard loom 4 and are located on the front end of the fell (shed), so by adjusting the height of the opening, the clarity of the fell can be improved, and the width of the fell can be widened. This is favorable for realizing four-color weft insertion.

The present invention adopts a water-spraying weft insertion weaving mode and an electronic let-off and take-up mechanism and has four electronic weft accumulators, wherein the maximum looming breadth is 360 cm. In terms of texture design, the jacquard part is of a double weft texture, while the lining is of a double warp texture, and the interlocking means is that the external warps are interlocked with the internal wefts. Input the designed CAD pattern document into the weaver, adjust the weft insertion parameters, and then production can be carried out.

The weaving body 1 is provided with a mesh plate 16 with a plurality of holes; every one of the harness cords 9 passes through a hole on the mesh plate 16 and then is connected to one of the first harnesses 7. During installation, the mesh plate 16 is drilled to form inclined holes, meanwhile the dobby loom is wholly moved back by 1-2 cm, which further increases the space of the jacquard loom and is favorable for high-speed weaving. The means of combining the jacquard loom 4 and the dobby loom 5 realizes high-density jacquard weaving; a stabilizer installed on the shed further improves the clarity of the fell; meanwhile the mesh plate 16 is drilled in an inclined way, which enlarges the movement space for the harness wires and ensures the smooth return of the return springs 10; moreover, the high-pressure water pump is installed to wash the harness wires and the return springs 10, which can quickly wash the slurry dropped during weaving, improve the life time of the return springs 10 and guarantee regular weaving.

A double-loom weaving method is provided, which is realized by the above-mentioned weaving machine. The weaving body 1 is provided with the jacquard loom 4 and dobby loom 5 at the same time; the jacquard loom 4 is connected with the first harness wires 7 via the harness cords 9; the lower ends of the first harness wires 7 are connected to the return springs 10; the dobby loom 5 is connected to the second harness wires 8; the first warp 13 on the first warp beam 2 passes through the first heald eyes 11 on the first harness wires 7; the second warp 14 on the second warp beam 3 passes through the second heald eyes 12 on the second harness wires 8; then the jacquard loom 4 and the dobby loom 5 respectively drive the first harness wires 7 and the second harness wires 8 to move vertically; the first warp 13 and the second warp 14 respectively follow the first harness wires 7 and the second harness wires 8 to move vertically to be separated into two layers and form a shed such that the weft on the welt accumulator passes through the shed to move.

Figure 3:
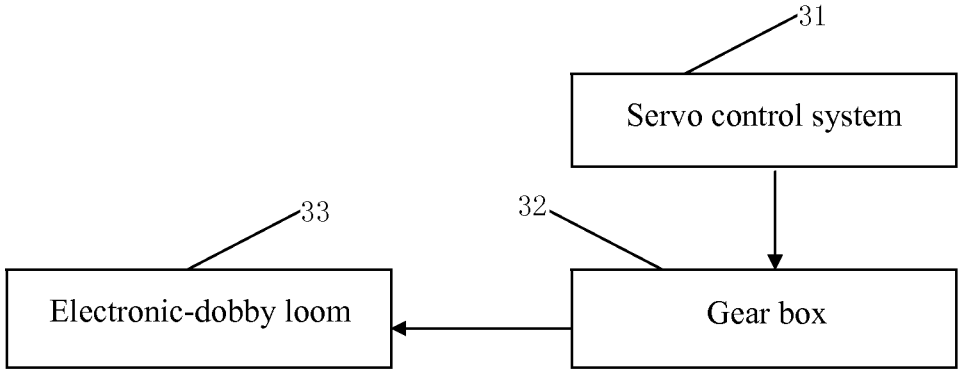
FIG. 3 illustrates a structural view of a servo jacquard device of the present invention.

The jacquard loom 4 is a servo jacquard device as shown in FIG. 3, comprising a servo control system 31, a gear box 32 and an electronic jacquard loom 33, wherein the servo control system 31 is connected to the gear box 32; and the output end of the gear box 32 is connected to the electronic jacquard loom 33. The servo control system 31 comprises a servo controller, a servo motor, a differential encoder, a brake resistor, and a signal controller; the servo controller is connected to the servo motor; the output end of the servo motor is connected to the gear box 32; and the brake resistor, the differential encoder and the signal controller are connected to the servo controller. The servo jacquard device performs precise location by using the differential encoder, controls the rotation of the servo motor by the servo controller, drives the jacquard loom to move by the motor servo, and realizes the vertical motion of the warps according to the jacquard weaving signal. The shed is formed without the power system of the weaving machine, which reduces loads on the main motor of the weaving machine, lowers the power of the spindle motor of the weaving machine, and meets the power requirement for super-startup of the water-spraying weaving. In comparison with the vertical shaft drive, servo drive not only effectively reduces noises, mechanical abrasion and saves space, but also optionally sets or changes the leveling position of the harnesses of the weaving machine by using the control system during weaving and improves the weaving speed.

Figure 4:
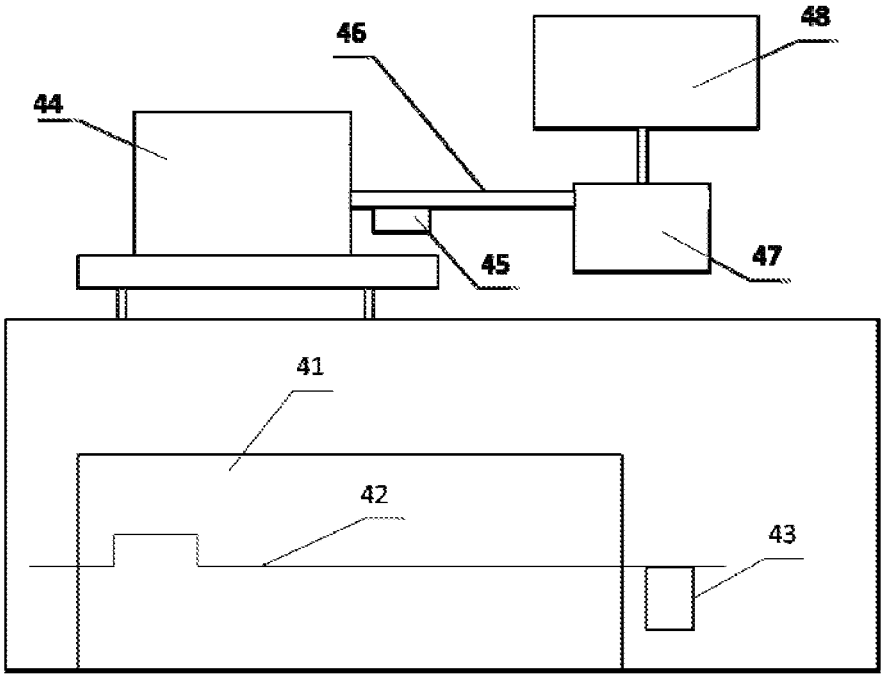
FIG. 4 illustrates structural views of an electronic-dobby-and-jacquard-loom and a synchronous transmission device of the present invention.
Figure 5:
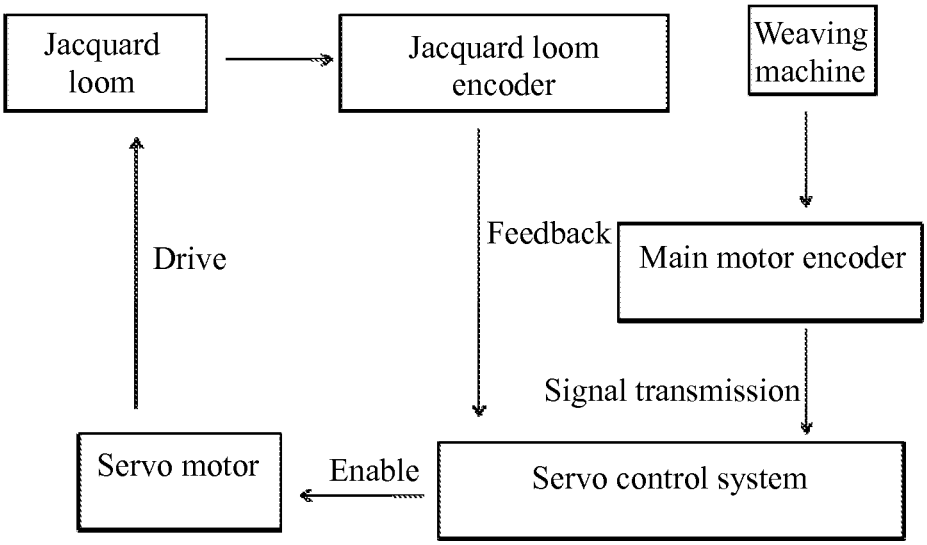
FIG. 5 illustrates principle control diagrams of an electronic-dobby-and-jacquard-loom and a synchronous transmission device of the present invention.

FIGS. 4 and 5 illustrate the electronic-dobby-and-jacquard-loom and the synchronous transmission device, which comprises a weaving body 41, a jacquard loom 44 and a synchronous transmission mechanism. The weaving body 41 is a water-spraying dobby weaver. The synchronous transmission mechanism comprises a weaving spindle 42, a main motor encoder 43, a jacquard loom encoder 45, a jacquard loom transmission shaft 46, a gear box 47 and a servo control system 48. The main motor encoder 43 is connected to the weaving spindle 42 of the weaving body 41. The jacquard loom encoder 45 is connected to the jacquard loom transmission shaft 46. The servo control system 48 is integrated with the gear box 47 and connected with the jacquard loom 44 via the jacquard loom transmission shaft 46. When this kind of machine is working, the weaving body 41 starts to normally run first. The main motor encoder 43 detects the running information of the weaving body 41 by the speed of the weaving spindle 42 of the weaving body 41, wherein the running information includes the angle, speed, stop position and others of the weaving body 41. The main motor encoder 43 may be a differential encoder. After defecting the running information of the weaving body 41, the main motor encoder 43 transmits the running information of the weaving body 41 to the servo control system 48. The servo control system 48 enables the serve motor to rotate (by the gear box 47) according to the running information of the weaving body 41 and drives the jacquard loom 44 to rotate by the serve motor. When the jacquard loom 44 rotates, the jacquard loom encoder 45 on the jacquard loom transmission shaft 46 detects the running information of the jacquard loom 44 and feeds back the running information to the servo control system 48. After receiving the information fed back from the jacquard loom 44, the servo control system 48 compares the running information with the running information of the weaving body 41; if the information is consistent, the weaving body 41 and the jacquard loom 44 will continue to rotate synchronously; and if not, the running states of the weaving body 41 and the jacquard loom 44 will be adjusted to be consistent by the gear box 47 to realizes synchronous rotation, and then the twp keep highly synchronous, thus meeting the requirements for high-density weaving.

The above embodiments are only used for description, and shall not be regarded as the limit of the present invention. Any simple variation on the basis of the present invention shall be within the protection scope thereof.

What is claimed is:

1. An electronic-dobby-and-jacquard-loom weaving machine, comprising a main body, a first warp beam, a second warp beam, a jacquard loom, a dobby, a heald frame, a plurality of first harness wires, a plurality of second harness wires, a plurality of harness cords, a plurality of return springs and at least one well accumulator, wherein the main body is provided with the dobby, while the jacquard loom is arranged above the main body; the jacquard loom is provided with a plurality of harness cords of which the lower ends are connected with the first hardness wires; the lower ends of the first harness wires are connected with return springs; the lower ends of the return springs are fixed on the main body; the first harness wires are provided with first heald eyes; the lower part of the dobby is connected with the heald frame; the heald frame is provided with a plurality of second harness wires inside; the second harness wires are provided with second heald eyes; the first warp beam and the second warp beam are respectively coiled with a first warp and a second warp; either the first warp or the second pwarp passes through the first heald eyes, while the other passes through the second heald eyes; the first warp and the second warp form a shed along with the motion of the first and second harness wires; wefts on the weft accumulator passes through the shed.

2. The electronic-dobby-and-jacquard-loom weaving machine according to claim 1, characterized in that: the main body and the jacquard loom are connected with a synchronous transmission mechanism between them; the synchronous transmission mechanism comprises a main shaft, a main motor encoder, a jacquard loom transmission shaft, a jacquard loom encoder, a gear box and a servo control system; the main motor encoder is connected to the main shaft of the main body; the jacquard loom encoder is connected to the jacquard loom transmission shaft; the servo control system is integrated with the gear box and connected to the jacquard loom via the jacquard loom transmission shaft; and both the main motor encoder and the jacquard loom encoder are connected to the servo control system.

3. The electronic-dobby-and-jacquard-loom weaving machine according to claim 2, characterized in that: the jacquard loom encoder and the main motor encoder both are differential encoders; the main body is a water-spraying dobby weaver.

4. The electronic-dobby-and-jacquard-loom weaving machine according to claim 1, characterized in that: the first warp beam and the second warp beam are distributed vertically; the first warp beam is the upper warp beam, while the second warp beam is the lower warp beam; the first warp on the first warp beam passes through the first heald eyes, the second warp on the second warp beam passes thought the second heald eyes; or the first warp on the first warp beam passes through the second heald eyes, the second warp on the second warp beam passes through the first heald eyes; and the first warp beam and the second warp beam both are located on the rear of the main body.

5. The electronic-dobby-and-jacquard-loom weaving machine according to claim 1, characterized in that the main body is also provided with a harness board with a plurality of holes; each harness cord passes through a hole on the hardness board and then is connected to the corresponding first hardness wire; the holes on the harness board are inclined holes.

6. The electronic-dobby-and-jacquard-loom weaving machine according to claim 1, characterized in that: the jacquard loom is located above the dobby.

7. The electronic-dobby-and-jacquard-loom weaving machine according to claim 1, characterized in that: the main body is also provided with a high-pressure water pump of which the nozzle directly aims at the return spring.

8. The electronic-dobby-and-jacquard-loom weaving machine according to claim 1, characterized in that: the main body and the jacquard loop are connected with a servo jacquard device between them; the servo jacquard device comprises a servo control system and a gear box; the servo control system is connected to the gear box; and the output end of the gear box is connected to the jacquard loom.

9. The electronic-dobby-and jacquard-loom weaving machine according to claim 8, characterized in that: the servo control system comprises a servo controller, a servo motor, a brake resistor and a signal controller; the servo controller is connected to the servo motor; the output end of the servo motor is connected to the gear box; the braking resistor and the signal controller are connected with the servo controller; the servo control system also comprises a differential encoder; and the differential encoder is connected to the servo controller.

10. A dual-loom weaving method comprising: providing a main body, a first warp beam, a second warp beam, a jacquard loom, a dobby, a heald frame, a plurality of first harness wires, a plurality of second harness wires, a plurality of harness cords, a plurality of return springs and at least one weft accumulator; wherein the jacquard and dobby are provided at the same time; further connecting the jacquard loom with the first harness wires via the harness cords; connecting the lower ends of the first harness wires to the return springs; connecting the dobby to the second harness wires; passing a first warp from the first warp beam through first heald eyes on the first harness wires; passing a second warp from the second warp beam through second heald eyes on the second harness wires; jacquard and dobby respectively driving the first harness wire and the second harness wire to move vertically; the first and second warp respectively following the first harness wires and the second harness wires vertically and dividing the wires into two layers and forming a shed such that a weft on the weft accumulator passes through the shed.

* * * * *